US010508842B2

(12) United States Patent
Takayama et al.

(10) Patent No.: US 10,508,842 B2
(45) Date of Patent: Dec. 17, 2019

(54) HEAT PUMP DEVICE WITH SEPARATELY SPACED COMPONENTS

(71) Applicant: Mitsubishi Electric Corporation, Tokyo (JP)

(72) Inventors: Keisuke Takayama, Tokyo (JP); Hiroyuki Tachibana, Tokyo (JP); Toru Koide, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/563,317

(22) PCT Filed: Jul. 3, 2015

(86) PCT No.: PCT/JP2015/069283

§ 371 (c)(1),
(2) Date: Sep. 29, 2017

(87) PCT Pub. No.: WO2017/006389

PCT Pub. Date: Jan. 12, 2017

(65) Prior Publication Data

US 2018/0058735 A1 Mar. 1, 2018

(51) Int. Cl.
*F25B 31/02* (2006.01)
*F04B 39/00* (2006.01)
(Continued)

(52) U.S. Cl.
CPC ..... *F25B 31/026* (2013.01); *F04B 39/0061* (2013.01); *F04B 39/06* (2013.01);
(Continued)

(58) Field of Classification Search
CPC .... F25B 2500/13; F25B 31/026; F25B 30/02; F25B 2500/12; F25B 5/04; F25B 6/04;
(Continued)

(56) References Cited

U.S. PATENT DOCUMENTS 1,426,352 A * 8/1922 Brush ..... F01N 1/089 181/255
3,766,748 A * 10/1973 Bottum ..... B60H 1/3204 62/243
(Continued)

FOREIGN PATENT DOCUMENTS

JP S57-148013 U 3/1981
JP S58-120087 A 7/1983
(Continued)

OTHER PUBLICATIONS

International Preliminary Report on Patentability dated Jan. 18, 2018 issued in corresponding international patent application No. PCT/JP2015/069283 (and English translation thereof).
(Continued)

*Primary Examiner* — Ljiljana V. Ciric
(74) *Attorney, Agent, or Firm* — Posz Law Group, PLC

(57) ABSTRACT

A heat pump device includes a compressor, a motor, a shell, a muffler, a heat exchanger, a housing, a blower, a first insulating material, and a second insulating material. The compressor compresses refrigerant. The motor drives the compressor. The shell houses the motor and the compressor. The compressor is connected to the muffler, which is further connected to heat exchanger. The housing has first and second spaces. The shell, the heat exchanger, and the muffler are disposed in the first space. The blower is disposed in the second space. The muffler is entirely located within a space between the shell and the first heat exchanger. The first insulating material at least partially cover the discharge muffler and the first heat exchanger. The second insulating material at least partially cover the shell. The first insulating material has a higher thermal resistance than the second insulating material.

20 Claims, 7 Drawing Sheets

(51) Int. Cl.
*F04B 39/06* (2006.01)
*F25B 30/02* (2006.01)

(52) U.S. Cl.
CPC ..... *F25B 30/02* (2013.01); *F25B 2500/12* (2013.01); *F25B 2500/13* (2013.01)

(58) Field of Classification Search
CPC .. F25B 41/00; F25B 31/02; F25B 1/00; F04B 39/06; F04B 39/0061; F04B 35/04; F04B 39/00; F04C 29/06
USPC ..... 62/296
See application file for complete search history.

(56) References Cited

U.S. PATENT DOCUMENTS 3,792,690 A * 2/1974 Cooper ..... F02B 41/00 123/3
3,872,687 A * 3/1975 Bottum ..... B60H 1/3204 62/243
4,194,119 A * 3/1980 MacKenzie ..... F17C 13/006 165/185
4,287,720 A * 9/1981 Barthel ..... F17C 3/08 62/45.1
4,535,590 A * 8/1985 Jacobsen ..... G05D 23/1921 251/11
4,727,727 A * 3/1988 Reedy ..... F24D 17/02 62/238.6
4,991,406 A 2/1991 Fujii et al.
6,138,791 A * 10/2000 Zanzie ..... F01N 1/24 181/252
6,308,518 B1 * 10/2001 Hunter ..... F25B 21/02 62/3.3
2002/0185334 A1 * 12/2002 Kim ..... F01N 1/006 181/279
2003/0103851 A1 * 6/2003 Hauser ..... F04B 39/0022 417/373
2007/0257766 A1 * 11/2007 Richards ..... B82Y 10/00 337/298
2008/0310974 A1 * 12/2008 Possamai ..... F04B 39/023 417/372
2009/0113903 A1 * 5/2009 Babkin ..... C09K 5/041 62/114
2009/0155114 A1 * 6/2009 Kwan ..... F04B 39/06 418/179
2010/0089092 A1 * 4/2010 Hasegawa ..... F01C 13/04 62/498
2010/0162742 A1 * 7/2010 Shimoda ..... F25B 13/00 62/238.6
2010/0322793 A1 * 12/2010 Tsukamoto ..... F04B 35/04 417/410.1
2011/0256002 A1 * 10/2011 Ikeda ..... F04B 35/04 417/410.1
2012/0011876 A1 1/2012 Sata et al.
2012/0251358 A1 * 10/2012 Ota ..... F01C 21/10 417/410.5
2012/0273299 A1 * 11/2012 Jones ..... F01N 1/006 181/228
2013/0045119 A1 * 2/2013 Junior ..... F04B 39/06 417/313
2014/0238067 A1 * 8/2014 Itou ..... F25B 41/04 62/324.6
2015/0159924 A1 * 6/2015 Calderon ..... F25D 11/006 62/3.6
2015/0226453 A1 8/2015 Nomoto et al.
2015/0241132 A1 * 8/2015 Yanachi ..... F28F 1/40 165/154
2015/0275883 A1 * 10/2015 Lilie ..... F04B 39/0055 417/437
2016/0177974 A1 * 6/2016 Tanaka ..... F04F 5/46 417/151
2016/0185184 A1 * 6/2016 Morishita ..... F04B 35/04 62/79
2018/0058454 A1 * 3/2018 Nakagami ..... F04B 49/10

FOREIGN PATENT DOCUMENTS

JP S59-112189 A 6/1984
JP S60-004791 A 1/1985
JP S62-009154 A 1/1987
JP H02-067823 U 5/1990
JP H07-035374 A 2/1995
JP 09-196514 A 7/1997
JP 2001-173998 A 6/2001
JP 2003-166472 A 6/2003
JP 2005-221088 A 8/2005
JP 2006-132427 A 5/2006
JP 2008-175066 A 7/2008
JP 2009-008363 A 1/2009
JP 2010-223190 A 10/2010
JP 2012-107791 A 6/2012
JP 2012-193934 A 10/2012
JP 2013-096674 A 5/2013
WO 2014/050274 A1 4/2014
WO 2014/083673 A1 6/2014

OTHER PUBLICATIONS

International Search Report of the International Searching Authority dated Sep. 1, 2015 for the corresponding international application No. PCT/JP2015/069283 (and English translation).
Office Action dated Jun. 5, 2018 issued in corresponding JP patent application No. 2017-526798 (and English translation).
Office Action dated Oct. 16, 2018 in corresponding JP patent application No. 2017-526798 (and English translation).
Office Action dated Jun. 13, 2019 issued in corresponding CN patent application No. 201580080515.X (and English machine translation).
Extended EP Search Report dated Jan. 25, 2019 issued in corresponding EP patent application No. 15897652.2.

* cited by examiner

HEAT PUMP DEVICE WITH SEPARATELY SPACED COMPONENTS

CROSS REFERENCE TO RELATED APPLICATION

This application is a U.S. national stage application of International Application No. PCT/JP2015/069283 filed on Jul. 3, 2015, the disclosure of which is incorporated herein by reference.

TECHNICAL FIELD

The present invention relates to a heat pump device.

BACKGROUND

PTL 1 described below discloses a hot water supply cycle apparatus including a gas cooler and a hot water supply compressor. The gas cooler includes high temperature-side refrigerant piping, low temperature-side refrigerant piping, and water piping. The hot water supply compressor includes a shell, a compression mechanism, a motor, a suction pipe, a discharge pipe, a refrigerant re-introduction pipe, and a refrigerant re-discharge pipe. The apparatus operates as follows. The suction pipe directly guides a low pressure refrigerant to the compression mechanism. A high pressure refrigerant compressed by the compression mechanism is directly discharged to the outside of the shell through the discharge pipe without being released into the shell. The discharged high pressure refrigerant is subjected to heat exchange while passing through the high temperature-side refrigerant piping. The refrigerant after the heat exchange is guided into the shell through the refrigerant re-introduction pipe. The refrigerant having passed through the motor in the shell is re-discharged to the outside of the shell through the refrigerant re-discharge pipe and fed to the low temperature-side refrigerant piping.

PATENT LITERATURE

PTL 1 Japanese Patent Application Laid-open No. 2006-132427

In the conventional apparatus described above, the refrigerant compressed by the compression mechanism is directly discharged to the outside of the shell without being released into the shell. Thus, vibration and noise may possibly occur due to pulsation of pressure generated by the compression mechanism being transmitted to the gas cooler.

SUMMARY

The present invention has been made in order to solve problems such as that described above and an object thereof is to provide a heat pump device capable of reducing vibration and noise while reducing a decline in heating efficiency.

A heat pump device of the invention includes: a compression mechanism configured to compress refrigerant; a motor configured to drive the compression mechanism; a shell housing the compression mechanism and the motor; a discharge muffler being outside of the shell; a first pipe connecting the compression mechanism to the discharge muffler; a first heat exchanger including a refrigerant inlet, the first heat exchanger being configured to exchange heat between the refrigerant and a heating medium; and a second pipe connecting the discharge muffler to the refrigerant inlet of the first heat exchanger. The shell and the discharge muffler are spatially located next to each other The discharge muffler and the first heat exchanger are spatially located next to each other The discharge muffler is at least partially located in a space between the shell and the first heat exchanger.

With the heat pump device according to the present invention, by positioning a discharge muffler at least partially in a space between a shell and a first heat exchanger, the shell housing a compression mechanism and a motor, vibration and noise can be reduced while reducing a decline in heating efficiency.

DETAILED DESCRIPTION

Figure 1:
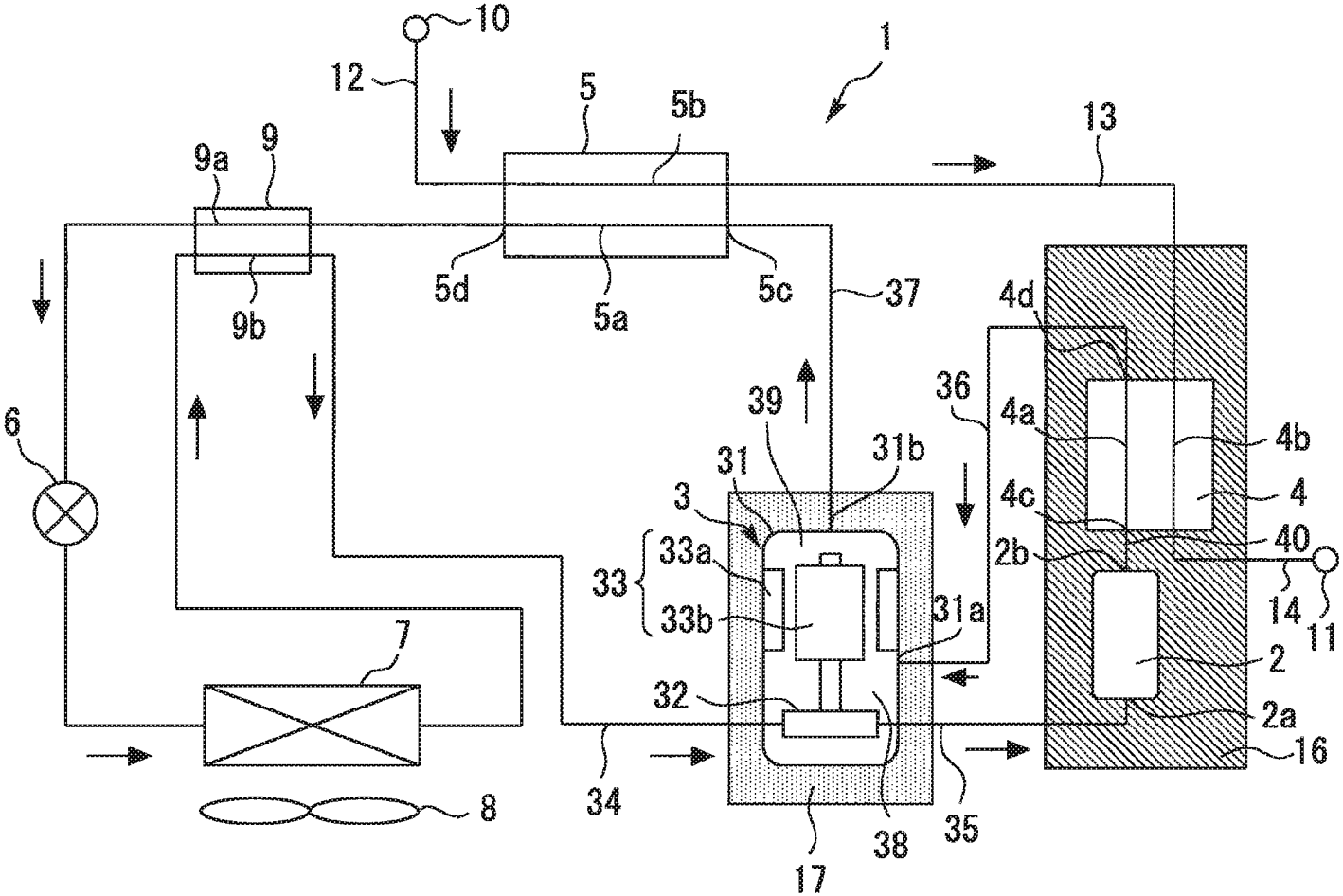
FIG. 1 is a diagram showing a refrigerant circuit configuration of a heat pump device according to a first embodiment of the present invention.

Hereinafter, embodiments of the present invention will be described with reference to the drawings. Note that common elements in the drawings are denoted by same reference signs and overlapping descriptions will be simplified or omitted. Moreover, generally, the numbers, arrangements, orientations, shapes, and sizes of apparatuses, instruments, parts, and the like according to the present invention are not limited to the numbers, arrangements, orientations, shapes, and sizes depicted in the drawings. In addition, the present invention is to include all possible combinations of combinable configurations among the configurations described in the respective embodiments below. In the present specification, "water" is a concept encompassing liquid water in all temperature ranges from low-temperature cold water to high-temperature hot water.

First Embodiment

FIG. 1 is a diagram showing a refrigerant circuit configuration of a heat pump device according to a first embodiment of the present invention. As shown in FIG. 1, a heat pump device 1 according to the present first embodiment is provided with a refrigerant circuit including a discharge muffler 2, a compressor 3, a first heat exchanger 4, a second heat exchanger 5, an expansion valve 6, and an evaporator 7. The first heat exchanger 4 and the second heat exchanger 5 are heat exchangers which heat a heating medium using heat of a refrigerant. The first heat exchanger 4 includes a refrigerant passage 4*a*, a heating medium passage 4*b*, a refrigerant inlet 4*c*, and a refrigerant outlet 4*d*. Heat is exchanged between the refrigerant flowing through the refrigerant passage 4*a* and the heating medium flowing through the heating medium passage 4*b*. The second heat exchanger 5 includes a refrigerant passage 5*a*, a heating medium passage 5*b*, a refrigerant inlet 5*c*, and a refrigerant outlet 5*d*. Heat is exchanged between the refrigerant flowing through the refrigerant passage 5*a* and the heating medium flowing through the heating medium passage 5*b*. In the present first embodiment, a case where the heating medium is water will be described. The heating medium according to the present invention may be a fluid other than water such as brine or antifreeze.

The expansion valve 6 represents an example of a decompressor which decompresses the refrigerant. The evaporator 7 is a heat exchanger which causes the refrigerant to evaporate. The evaporator 7 according to the present first embodiment is an air-refrigerant heat exchanger which exchanges heat between air and the refrigerant. The heat pump device 1 further includes an air blower 8 and a high/low pressure heat exchanger 9. The air blower 8 feeds air to the evaporator 7. The high/low pressure heat exchanger 9 exchanges heat between a high pressure refrigerant and a low pressure refrigerant. In the present first embodiment, for example, carbon dioxide can be used as the refrigerant. When carbon dioxide is used as the refrigerant, pressure on a high pressure-side of the refrigerant circuit becomes supercritical pressure. In the present invention, a refrigerant other than carbon dioxide may be used and the pressure on the high pressure-side of the refrigerant circuit may be set lower than critical pressure. The evaporator 7 according to the present invention is not limited to the heat exchanger which exchanges heat between air and the refrigerant and may be, for example, a heat exchanger which performs heat exchange between groundwater, solar-heated hot water, or the like and the refrigerant. The high/low pressure heat exchanger 9 includes a high pressure passage 9*a* and a low pressure passage 9*b*. Heat is exchanged between the high pressure refrigerant flowing through the high pressure passage 9*a* and the low pressure refrigerant flowing through the low pressure passage 9*b*.

The compressor 3 includes a shell 31, a compression mechanism 32, and a motor 33. The shell 31 is a hermetic metallic container. The shell 31 separates an internal space and external space from each other. The shell 31 houses the compression mechanism 32 and the motor 33. In other words, the compression mechanism 32 and the motor 33 are arranged in the internal space of the shell 31. The shell 31 includes a refrigerant inlet 31*a* and a refrigerant outlet 31*b*. The refrigerant inlet 31*a* and the refrigerant outlet 31*b* are communicated with the internal space of the shell 31. The compression mechanism 32 is configured to compress the refrigerant. The compression mechanism 32 includes a compression space (not shown) in which the refrigerant is sealed and compressed. A low pressure refrigerant is compressed by the compression mechanism 32 to become a high pressure refrigerant. The compression mechanism 32 may be of any type including a reciprocating type, a scroll type, and a rotary type. The compression mechanism 32 is driven by the motor 33. The motor 33 is an electric motor which includes a stator 33*a* and a rotor 33*b*.

The compression mechanism 32 is arranged on a lower side of the motor 33. The internal space of the shell 31 includes an internal space 38 between the compression mechanism 32 and the motor 33 and an internal space 39 on an upper side of the motor 33. A first pipe 35, a third pipe 36, a fourth pipe 37, and a fifth pipe 34 are connected to the compressor 3. The high pressure refrigerant compressed by the compression mechanism 32 is directly discharged to the first pipe 35 without being released into the internal spaces 38 and 39 of the shell 31. The high pressure refrigerant is fed to the discharge muffler 2 through the first pipe 35.

The discharge muffler 2 is arranged outside the shell 31. The discharge muffler 2 is made of metal. The discharge muffler 2 includes an inlet 2*a* and an outlet 2*b*. The first pipe 35 connects a discharge side of the compression mechanism 32 to the inlet 2*a* of the discharge muffler 2. The discharge muffler 2 receives the high pressure refrigerant compressed by the compression mechanism 32 from the first pipe 35. The discharge muffler 2 has a larger internal space than the first pipe 35. The high pressure refrigerant discharged from the compression mechanism 32 has pressure pulsation. The internal space of the discharge muffler 2 has a capacity enabling the pressure pulsation of the high pressure refrigerant to be sufficiently reduced. A flow velocity of the high pressure refrigerant decreases as the high pressure refrigerant enters the discharge muffler 2 from the first pipe 35. The drop in the flow velocity of the high pressure refrigerant causes the pressure pulsation decline. An outer surface area of the discharge muffler 2 is larger than an outer surface area of the first pipe 35.

A second pipe 40 connects the outlet 2*b* of the discharge muffler 2 to the refrigerant inlet 4*c* of the first heat exchanger 4. The high pressure refrigerant whose pressure pulsation has been reduced by the discharge muffler 2 passes through the second pipe 40 and flows into the refrigerant passage 4*a* of the first heat exchanger 4. The high pressure refrigerant is cooled by water when passing through the refrigerant passage 4*a* of the first heat exchanger 4. The third pipe 36 connects the refrigerant outlet 4*d* of the first heat exchanger 4 to the refrigerant inlet 31*a* of the shell 31. The high pressure refrigerant having passed through the first heat exchanger 4 passes through the third pipe 36 and returns to the compressor 3 from the first heat exchanger 4.

According to the present embodiment, the following effects are produced due to the inclusion of the discharge muffler 2. Pressure pulsation of the high pressure refrigerant discharged from the compression mechanism 32 can be prevented from acting on the first heat exchanger 4. Vibration of the first heat exchanger 4 can be reduced. Noise can be reduced.

The refrigerant inlet 31*a* of the shell 31 and an outlet of the third pipe 36 are communicated with the internal space 38 between the motor 33 and the compression mechanism 32. The high pressure refrigerant having passed through the third pipe 36 and re-introduced into the compressor 3 is discharged into the internal space 38 between the motor 33 and the compression mechanism 32. The fourth pipe 37 connects the refrigerant outlet 31*b* of the shell 31 to the refrigerant inlet 5*c* of the second heat exchanger 5. The refrigerant outlet 31*b* of the shell 31 and an inlet of the fourth pipe 37 are communicated with the internal space 39 on the upper side of the motor 33. The high pressure refrigerant in the internal space 38 passes through a gap between the rotor 33*b* and the stator 33*a* of the motor 33 and the like and reaches the internal space 39 on the upper side of the motor 33. At this point, the motor 33 at a high temperature is cooled by the high pressure refrigerant. The high pressure refrigerant is heated by the heat of the motor 33. Since the high pressure refrigerant of the internal space 38 is cooled by the first heat exchanger 4, a temperature thereof is lower than that of the high pressure refrigerant discharged from the compression mechanism 32. According to the present embodiment, since the motor 33 can be cooled with the high pressure refrigerant having a relatively low temperature, its cooling effect is high. The high pressure refrigerant in the internal space 39 on the upper side of the motor 33 passes, without being compressed, through the fourth pipe 37 to be supplied to the refrigerant passage 5*a* of the second heat exchanger 5.

The high pressure refrigerant is cooled by water when passing through the refrigerant passage 5*a* of the second heat exchanger 5. The high pressure refrigerant having passed through the second heat exchanger 5 flows into the high pressure passage 9*a* of the high/low pressure heat exchanger 9. The high pressure passage having passed through the high pressure passage 9*a* reaches the expansion valve 6. The high pressure refrigerant is decompressed when expanding at the expansion valve 6 and becomes a low pressure refrigerant. This low pressure refrigerant flows into the evaporator 7. In the evaporator 7, the low pressure refrigerant is heated by outside air fed by the air blower 8 and evaporates. The low pressure refrigerant having passed through the evaporator 7 flows into the low pressure passage 9*b* of the high/low pressure heat exchanger 9. The low pressure refrigerant having passed through the low pressure passage 9*b* passes through the fifth pipe 34 and is sucked into the compressor 3. The fifth pipe 34 connects an outlet of the low pressure passage 9*b* of the high/low pressure heat exchanger 9 to a suction side of the compression mechanism 32. The low pressure refrigerant having passed through the fifth pipe 34 is guided to the compression mechanism 32 without being discharged to the internal spaces 38 and 39 of the shell 31. Moreover, due to heat exchange by the high/low pressure heat exchanger 9, the high pressure refrigerant in the high pressure passage 9*a* is cooled and the low pressure refrigerant in the low pressure passage 9*b* is heated.

Pressure of the high pressure refrigerant in the internal spaces 38 and 39 of the shell 31 is slightly lower than pressure of the high pressure refrigerant discharged from the compression mechanism 32. This is because pressure loss occurs when the high pressure refrigerant passes through the first pipe 35, the discharge muffler 2, the second pipe 40, the refrigerant passage 4*a* of the first heat exchanger 4, and the third pipe 36.

The heat pump device 1 includes a heating medium inlet 10, a heating medium outlet 11, a first passage 12, a second passage 13, and a third passage 14. The first passage 12 connects the heating medium inlet 10 with an inlet of the heating medium passage 5*b* of the second heat exchanger 5. The second passage 13 connects an outlet of the heating medium passage 5*b* of the second heat exchanger 5 with an inlet of the heating medium passage 4*b* of the first heat exchanger 4. The third passage 14 connects an outlet of the heating medium passage 4*b* of the first heat exchanger 4 with the heating medium outlet 11.

A heating operation in which the heat pump device 1 heats water (a heating medium) is as follows. The water before being heated enters the heat pump device 1 from the heating medium inlet 10. The water then passes through the heating medium inlet 10, the first passage 12, the heating medium passage 5*b* of the second heat exchanger 5, the second passage 13, the heating medium passage 4*b* of the first heat exchanger 4, the third passage 14, and the heating medium outlet 11 in this order. Hot water after being heated exits the heat pump device 1 from the heating medium outlet 11. In the present embodiment, water is fed by a pump located outside the heat pump device 1. Such a configuration is not restrictive and the heat pump device 1 may include a pump which feeds a heating medium. The temperature of water rises by being heated by the second heat exchanger 5. The temperature of water heated by the second heat exchanger 5 further rises by being heated by the first heat exchanger 4.

The temperature of the high pressure refrigerant inside the discharge muffler 2 is higher than the temperature of the high pressure refrigerant in the internal spaces 38 and 39 of the shell 31 of the compressor 3. This is because the high pressure refrigerant in the internal spaces 38 and 39 of the shell 31 has been cooled by the first heat exchanger 4. The temperature of an outer surface of the discharge muffler 2 is higher than the temperature of an outer surface of the shell 31 of the compressor 3. Supposing that heat is transferred from the discharge muffler 2 to the shell 31 of the compressor 3, the temperature of the high pressure refrigerant received by the first heat exchanger 4 from the discharge muffler 2 drops. As a result, a decline in efficiency of the first heat exchanger 4 causes water heating efficiency to decline.

As an example, when the heat pump device 1 heats water to 65° C., the following occurs. The temperature of the refrigerant compressed by the compression mechanism 32 rises to approximately 90° C. The temperature of the refrigerant after being cooled by the first heat exchanger 4 drops to approximately 60° C. In this case, the temperatures of the outer surfaces of the discharge muffler 2 and the first pipe 35 are approximately 90° C. The temperature of the outer surface of the shell 31 of the compressor 3 is approximately 60° C. When the heat pump device 1 heats water to even higher temperatures, a difference between the temperatures of the outer surfaces of the discharge muffler 2 and the first pipe 35 and the temperature of the outer surface of the shell 31 of the compressor 3 may further increase.

Thermal conductivity of the material constituting the discharge muffler 2 may be set lower than thermal conductivity of the material constituting the refrigerant pipes (the first pipe 35, the second pipe 40, the third pipe 36, the fourth pipe 37, the fifth pipe 34, and the like). For example, the discharge muffler 2 may be constructed with an iron-based or aluminum-based material and the refrigerant pipes may be constructed with a copper-based material. Adopting such a configuration more reliably reduces heat dissipation loss from the discharge muffler 2.

Hypothetically, installing a large discharge muffler inside the shell of the compressor creates the following disadvantages. A significant structural change is required. A size of the shell increases. Since a refrigerant immediately after being compressed by the compression mechanism flows through the discharge muffler, temperature is highest in a refrigerating cycle. A refrigerant cooled by the first heat exchanger flows into the shell. A refrigerant temperature in the shell is lower than in the discharge muffler. Installing a large discharge muffler in the shell results in a large outer surface area of the discharge muffler, causing heat to migrate from the discharge muffler to the refrigerant inside the shell and creates loss. With the present invention, such disadvantages are not created.

Figure 2:
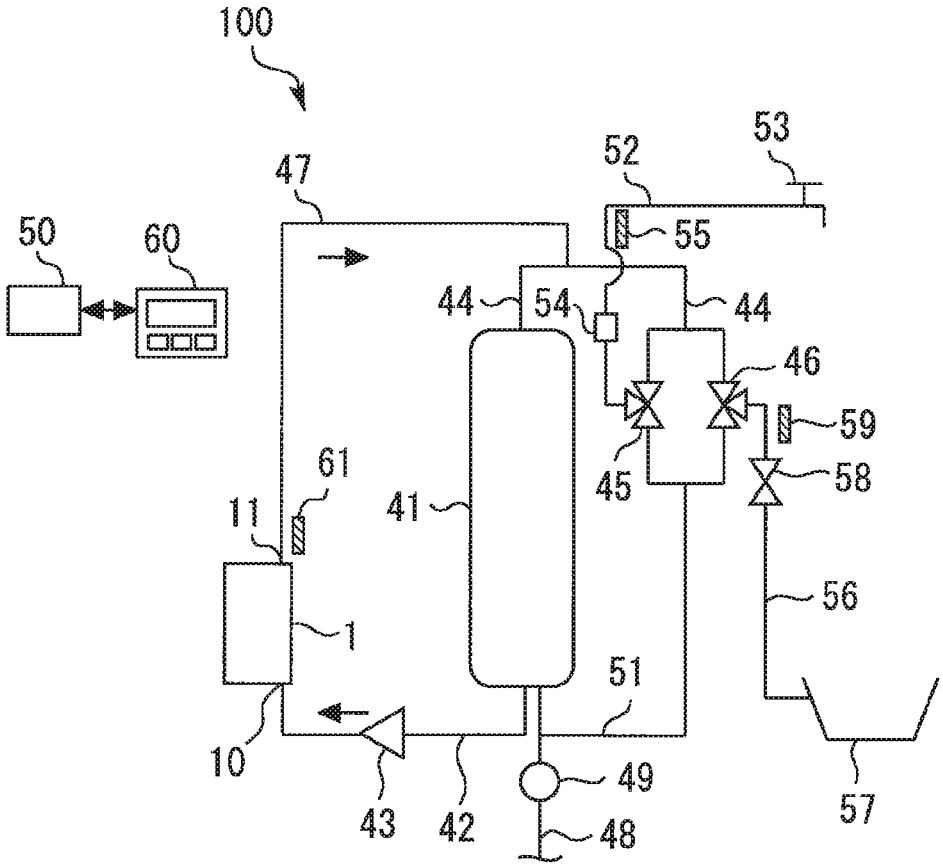
FIG. 2 is a configuration diagram of a hot water-storing hot water supply system including the heat pump device shown in FIG. 1.

FIG. 2 is a configuration diagram of a hot water-storing hot water supply system including the heat pump device 1 shown in FIG. 1. As shown in FIG. 2, a hot water-storing hot water supply system 100 according to the present embodiment includes the heat pump device 1 described above, a hot water storage tank 41, and a controller 50. The hot water storage tank 41 stores water while forming temperature stratification in which a temperature of an upper side is high and a temperature of a lower side is low. A lower part of the hot water storage tank 41 and the heating medium inlet 10 of the heat pump device 1 are connected to each other via an inlet pipe 42. A pump 43 is installed midway along the inlet pipe 42. One end of an upper pipe 44 is connected to an upper part of the hot water storage tank 41. Another end of the upper pipe 44 branches into two to be respectively connected to a first inlet of a hot water supply mixing valve 45 and a first inlet of a bath mixing valve 46. The heating medium outlet 11 of the heat pump device 1 is connected to a midway position of the upper pipe 44 via an outlet pipe 47.

A water supply pipe 48 which supplies water from a water source such as waterworks is connected to the lower part of the hot water storage tank 41. A pressure reducing valve 49 which reduces water source pressure to prescribed pressure is installed midway along the water supply pipe 48. Due to an inflow of water from the water supply pipe 48, the inside of the hot water storage tank 41 is constantly kept in a fully-filled state. A water supply pipe 51 branches from the water supply pipe 48 between the hot water storage tank 41 and the pressure reducing valve 49. A downstream side of the water supply pipe 51 branches into two to be respectively connected to a second inlet of the hot water supply mixing valve 45 and a second inlet of the bath mixing valve 46. An outlet of the hot water supply mixing valve 45 is connected to a hot water tap 53 via a hot water supply pipe 52. A hot water supply flow rate sensor 54 and a hot water supply temperature sensor 55 are installed in the hot water supply pipe 52. An outlet of the bath mixing valve 46 is connected to a bath tub 57 via a bath pipe 56. An on-off valve 58 and a bath temperature sensor 59 are installed in the bath pipe 56. A heat pump outlet temperature sensor 61 which detects a heat pump outlet temperature that is a temperature of water exiting the heat pump device 1 is installed in the outlet pipe 47 in a vicinity of the heating medium outlet 11 of the heat pump device 1.

The controller 50 is control means constituted by, for example, a microcomputer. The controller 50 is provided with memories including a ROM (Read Only Memory), a RAM (Random Access Memory), and a nonvolatile memory, a processor which executes arithmetic operation processes based on a program stored in the memories, and an input/output port which inputs and outputs external signals to and from the processor. The controller 50 is electrically connected to various actuators and sensors provided in the hot water-storing hot water supply system 100. In addition, the controller 50 is connected to an operating unit 60 so as to be capable of mutual communication. By operating the operating unit 60, a user can set a hot water supply temperature, a bath tub hot water amount, a bath tub temperature, and the like or make a timer reservation to have the bath tub filled with hot water at a given time of day. The controller 50 controls operations of the hot water-storing hot water supply system 100 by controlling an operation of each actuator according to a program stored in a storage unit based on information detected by each sensor, instruction information from the operating unit 60, and the like.

Next, a heat accumulating operation will be described. The heat accumulating operation is an operation for increasing an amount of stored hot water and an amount of stored heat in the hot water storage tank 41. When performing the heat accumulating operation, the controller 50 operates the heat pump device 1 and the pump 43. During the heat accumulating operation, low temperature water guided by the pump 43 from the lower part of the hot water storage tank 41 is sent to the heat pump device 1 through the inlet pipe 42, heated by the heat pump device 1, and becomes high temperature water. This high temperature water passes through the outlet pipe 47 and the upper pipe 44 and flows into the upper part of the hot water storage tank 41. Due to the heat accumulating operation described above, high temperature water is stored in the hot water storage tank 41 from an upper side.

During the heat accumulating operation, the controller 50 performs control so that the heat pump outlet temperature detected by the heat pump outlet temperature sensor 61 matches a target value (for example, 65° C.). The heat pump outlet temperature is lowered by controlling the pump 43 so that a flow rate of water flowing through the heat pump device 1 increases. The heat pump outlet temperature is raised by controlling the pump 43 so that the flow rate of water flowing through the heat pump device 1 decreases.

Next, a hot water supply operation will be described. The hot water supply operation is an operation for supplying hot water to the hot water tap 53. When the user opens the hot water tap 53, water from the water supply pipe 48 flows into the lower part of the hot water storage tank 41 due to water source pressure, causing the high temperature water in the upper part of the hot water storage tank 41 to flow out to the upper pipe 44. In the hot water supply mixing valve 45, low temperature water supplied from the water supply pipe 51 and high temperature water supplied from the hot water storage tank 41 through the upper pipe 44 are mixed. The mixed water passes through the hot water supply pipe 52 and is released to the outside from the hot water tap 53. At this point, the passage of the mixed water is detected by the hot water supply flow rate sensor 54. The controller 50 controls a mixing ratio of the hot water supply mixing valve 45 so that the hot water supply temperature detected by the hot water supply temperature sensor 55 equals a hot water supply temperature set value having been set by the user in advance using the operating unit 60.

Next, a hot water filling operation will be described. The hot water filling operation is an operation for filling the bath tub 57 with hot water. The hot water filling operation is started when the user performs a start operation of the hot water filling operation on the operating unit 60 or when the time of day set by a timer reservation arrives. When performing the hot water filling operation, the controller 50 switches the on-off valve 58 to an open state. Water from the water supply pipe 48 flowing into the lower part of the hot water storage tank 41 due to water source pressure causes the high temperature water in the upper part of the hot water storage tank 41 to flow out to the upper pipe 44. In the bath mixing valve 46, low temperature water supplied from the water supply pipe 51 and high temperature water supplied from the hot water storage tank 41 through the upper pipe 44 are mixed. The mixed water passes through the bath pipe 56 and the on-off valve 58, and is released into the bath tub 57. At this point, the controller 50 controls a mixing ratio of the bath mixing valve 46 so that the hot water supply temperature detected by the bath temperature sensor 59 equals a bath tub temperature set value having been set by the user in advance using the operating unit 60.

In the hot water-storing hot water supply system 100 according to the present embodiment, the heat pump device 1 directly heats water. Such a configuration is not restrictive and a configuration may be adopted in which water is indirectly heated by including a heat exchanger which heats water by exchanging heat between water and a heating medium heated by the heat pump device 1. In addition, the heat pump device according to the present invention is not limited to those used in a hot water-storing hot water supply system. For example, the heat pump device according to the present invention can also be applied to an apparatus which heats a liquid (a liquid heating medium) being circulated to perform indoor heating.

Figure 3:
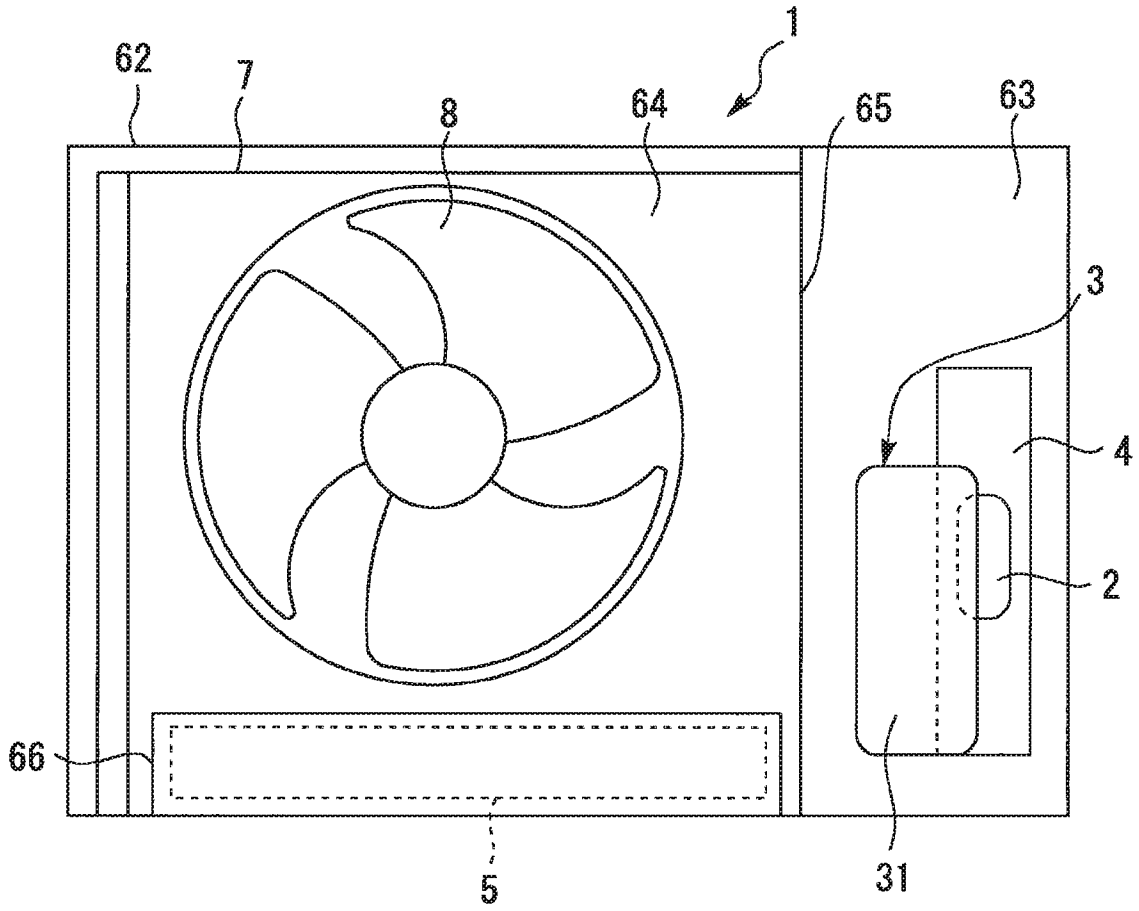
FIG. 3 is a schematic front view depicting the heat pump device shown in FIG. 1.
Figure 4:
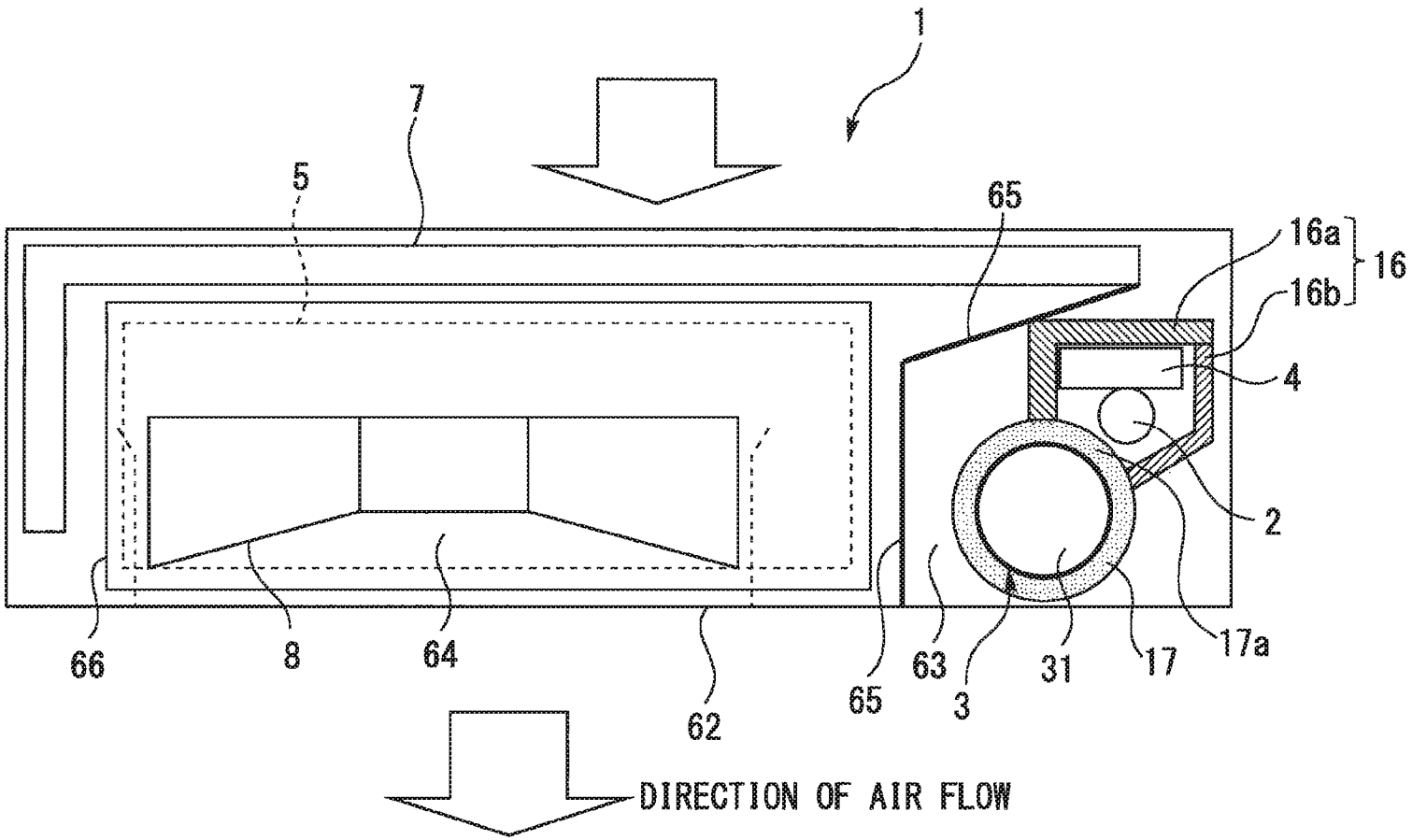
FIG. 4 is a schematic plan view depicting the heat pump device shown in FIG. 1.

FIG. 3 is a schematic front view depicting the heat pump device 1 shown in FIG. 1. FIG. 4 is a schematic plan view depicting the heat pump device 1 shown in FIG. 1. Refrigerant piping, water piping, a thermal insulator, and the like are not shown in FIG. 3. Refrigerant piping, water piping, and the like are not shown in FIG. 4. The devices included in the heat pump device 1 are actually arranged in a positional relationship shown in FIGS. 3 and 4. FIG. 1 schematically shows a refrigerant circuit configuration of the heat pump device 1 and does not present an actual positional relationship among the devices included in the heat pump device 1.

As shown in FIGS. 3 and 4, the heat pump device 1 includes a housing 62. FIG. 3 shows a state where a front panel of the housing 62 has been removed. FIG. 4 shows a state where a top panel of the housing 62 has been removed. A first space 63 and a second space 64 exist inside the housing 62. A bulkhead 65 separates the first space 63 and the second space 64 from each other. The discharge muffler 2, the compressor 3, and the first heat exchanger 4 are arranged in the first space 63. The second heat exchanger 5, the evaporator 7, and the air blower 8 are arranged in the second space 64.

The shell 31 of the compressor 3 has a cylindrical outer shape. The shell 31 of the compressor 3 is arranged in a posture in which an axial direction thereof equals a vertical direction. The discharge muffler 2 has a cylindrical outer shape. The discharge muffler 2 is arranged in a posture in which an axial direction thereof equals the vertical direction. An outer diameter of the discharge muffler 2 is smaller than an outer diameter of the shell 31 of the compressor 3. An axial length of the discharge muffler 2 is shorter than an axial length of the shell 31 of the compressor 3. As shown in FIG. 3, in the present embodiment, a height range in which the shell 31 of the compressor 3 is arranged and a height range in which the discharge muffler 2 is arranged overlap each other. In the present embodiment, the height range in which the discharge muffler 2 is arranged is included in the height range in which the shell 31 of the compressor 3 is arranged. In the present embodiment, the height range in which the discharge muffler 2 is arranged and a height range in which the first heat exchanger 4 is arranged overlap each other. In the present embodiment, the height range in which the discharge muffler 2 is arranged is included in the height range in which the first heat exchanger 4 is arranged.

A dimension of the first heat exchanger 4 in the vertical direction is larger than a dimension of the first heat exchanger 4 in a horizontal direction. A dimension of the second heat exchanger 5 in the vertical direction is smaller than a dimension of the second heat exchanger 5 in the horizontal direction.

The second heat exchanger 5 is housed in a case 66. The case 66 housing the second heat exchanger 5 is arranged in a lower part of the second space 64. The air blower 8 is arranged above the case 66. The evaporator 7 is arranged on a rear surface of the heat pump device 1. The air blower 8 is arranged so as to face the evaporator 7. Due to an operation of the air blower 8, air is sucked into the second space 64 of the housing 62 through the evaporator 7 from the rear surface side of the heat pump device 1. The evaporator 7 cools air. The cooled air passes through the second space 64. The cooled air passes through an opening formed on the front panel of the housing 62 and is discharged to a front side of the heat pump device 1.

A capacity of the second space 64 is desirably larger than a capacity of the first space 63. Configuring the capacity of the second space 64 to be larger than the capacity of the first space 63 enables a size of the evaporator 7 to be increased to increase a flow rate of air passing through the evaporator 7. The air having flowed through the evaporator 7 does not flow into the first space 63.

In winter, for example, a water temperature at the heating medium inlet 10 of the heat pump device 1 is 9° C. and a water temperature at the heating medium outlet 11 is 65° C. In this case, for example, the heat pump device 1 heats water from 9° C. to 65° C. In such a case, a certain amount of length (for example, around several m to 10 m) is required as a total length of a water flow channel inside the first heat exchanger 4 and the second heat exchanger 5 in a water flow direction. A heating amount with respect to water of the second heat exchanger 5 is larger than a heating amount with respect to water of the first heat exchanger 4. A total length of the water flow channel required inside the second heat exchanger 5 is longer than a total length of the water flow channel required inside the first heat exchanger 4. Thus, a space occupied by the second heat exchanger 5 is larger than a space occupied by the first heat exchanger 4. According to the present embodiment, by arranging the relatively large second heat exchanger 5 in the second space 64, a capacity of the first space 63 can be relatively reduced. As a result, the heat pump device 1 can be downsized.

A temperature of an outer surface of the second heat exchanger 5 is lower than a temperature of an outer surface of the first heat exchanger 4. Thus, even though the second heat exchanger 5 is arranged in the second space 64 through which cooled air flows, heat dissipation loss from the outer surface of the second heat exchanger 5 can be reduced.

The relatively small first heat exchanger 4 can be arranged in the first space 63 without incident. According to the present embodiment, by arranging the first heat exchanger 4 in the first space 63 together with the compressor 3, lengths of the first pipe 35 and the second pipe 40 can be reduced. By reducing the lengths of the first pipe 35 and the second pipe 40 which reach high temperatures, heat dissipation loss from the outer surfaces of the first pipe 35 and the second pipe 40 can be more reliably reduced. In addition, pressure loss at the first pipe 35 and the second pipe 40 can be reduced.

An air temperature in the first space 63 is higher than an air temperature in the second space 64. According to the present embodiment, by arranging the discharge muffler 2, the compressor 3, and the first heat exchanger 4 of which outer surfaces reach high temperatures in the first space 63 with a relatively high air temperature, heat dissipation loss from the outer surfaces of the discharge muffler 2, the compressor 3, and the first heat exchanger 4 can be more reliably reduced.

Figure 5:
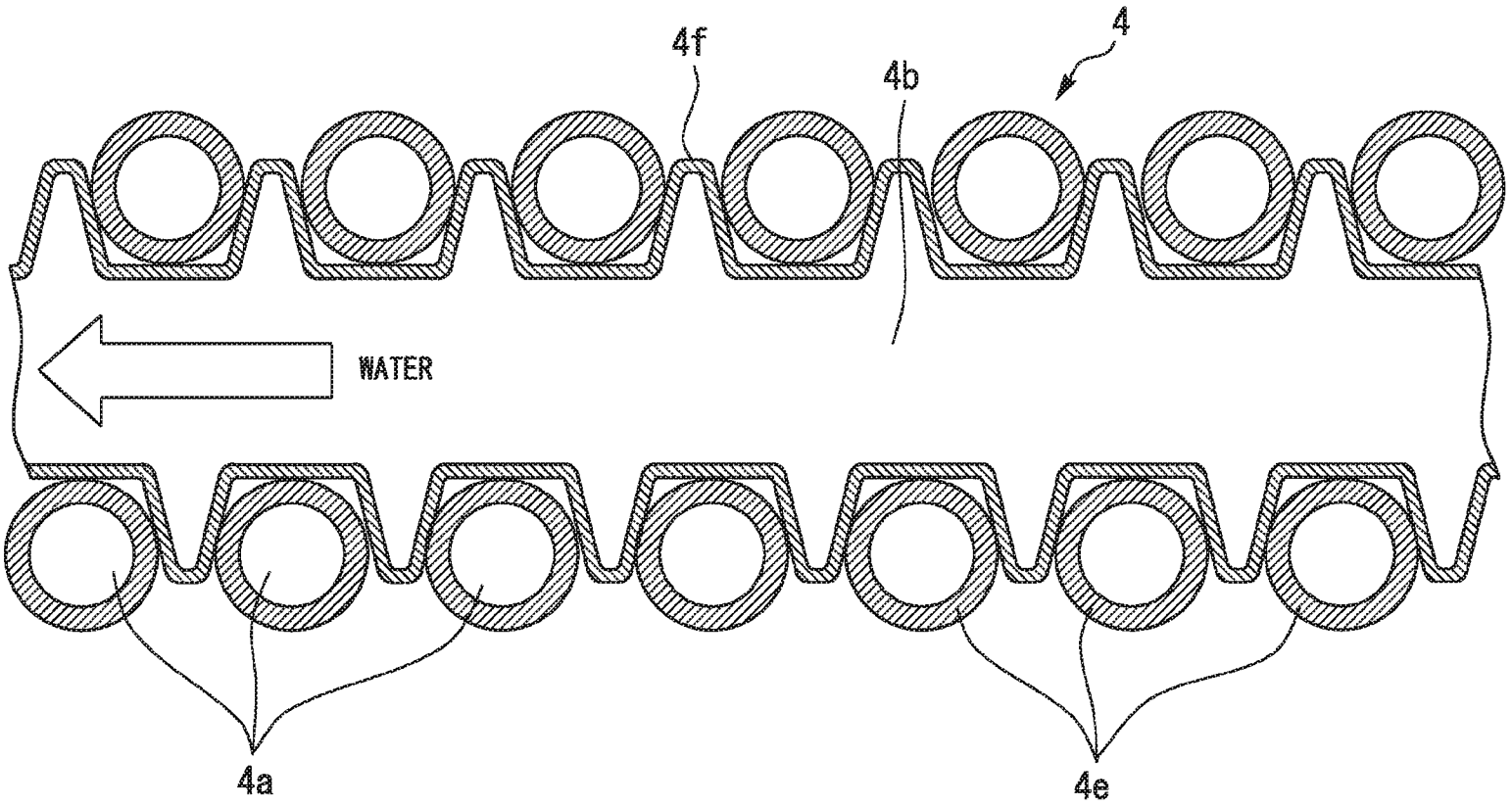
FIG. 5 is a cross-sectional view showing heat transfer pipes of the first heat exchanger provided in the heat pump device according to the second embodiment of the present invention.

FIG. 5 is a cross-sectional view showing heat transfer pipes of the first heat exchanger 4 provided in the heat pump device 1 according to the present first embodiment. As shown in FIG. 5, the first heat exchanger 4 includes a refrigerant pipe **4*e* and a heating medium pipe 4*f* as heat transfer pipes. An interior of the refrigerant pipe 4*e* corresponds to a refrigerant passage 4*a*. An interior of the heating medium pipe 4*f* corresponds to a heating medium passage 4*b*. The refrigerant pipe 4*e* is wound around the outside of the heating medium pipe 4*f* in a helical manner. The refrigerant passage 4*a* moves in a longitudinal direction of the heating medium passage 4*b* while rotating. The refrigerant pipe 4*e* is fixed to the heating medium pipe 4*f* by, for example, brazing. A helical groove is formed on an outer periphery of the heating medium pipe 4*f*. The refrigerant pipe 4*e* is fixed along this groove. The refrigerant pipe 4*e* is positioned partially inside the groove. Accordingly, a heat transfer area between the refrigerant pipe 4***e* and the heating medium pipe 4*f* can be increased.

The temperature of the refrigerant passing through the refrigerant passage 4*a* is higher than the temperature of the heating medium passing through the heating medium passage 4*b*. In the first heat exchanger 4 according to the present embodiment, the refrigerant passage 4*a* is arranged outside of the heating medium passage 4*b*. In the present embodiment, an outer surface of the refrigerant pipe 4*e* occupies most of an outer surface of the first heat exchanger 4. The outer surface of the refrigerant pipe 4*e* reaches a high temperature. Thus, the outer surface of the first heat exchanger 4 also reaches a high temperature.

As described earlier, the average temperature of the outer surface of the discharge muffler 2 is higher than the average temperature of the outer surface of the shell 31 of the compressor 3. The temperature of the refrigerant flowing through the refrigerant pipe 4*e* of the first heat exchanger 4 gradually drops as the heating medium draws heat from the refrigerant. Thus, an average temperature of the refrigerant flowing through the refrigerant pipe 4*e* of the first heat exchanger 4 is lower than the temperature of the refrigerant inside the discharge muffler 2 but higher than the temperature of the refrigerant inside the shell 31. Accordingly, an average temperature of the outer surface of the first heat exchanger 4 is lower than the average temperature of the outer surface of the discharge muffler 2 but higher than the average temperature of the outer surface of the shell 31.

Among the devices constituting the heat pump device 1, the discharge muffler 2 has a highest average outer surface temperature. The first heat exchanger 4 has a second highest average outer surface temperature. The shell 31 has a third highest average outer surface temperature. The average temperatures of the outer surfaces of the discharge muffler 2, the first heat exchanger 4, and the shell 31 are all higher than an average air temperature of the first space 63.

Figure 6:
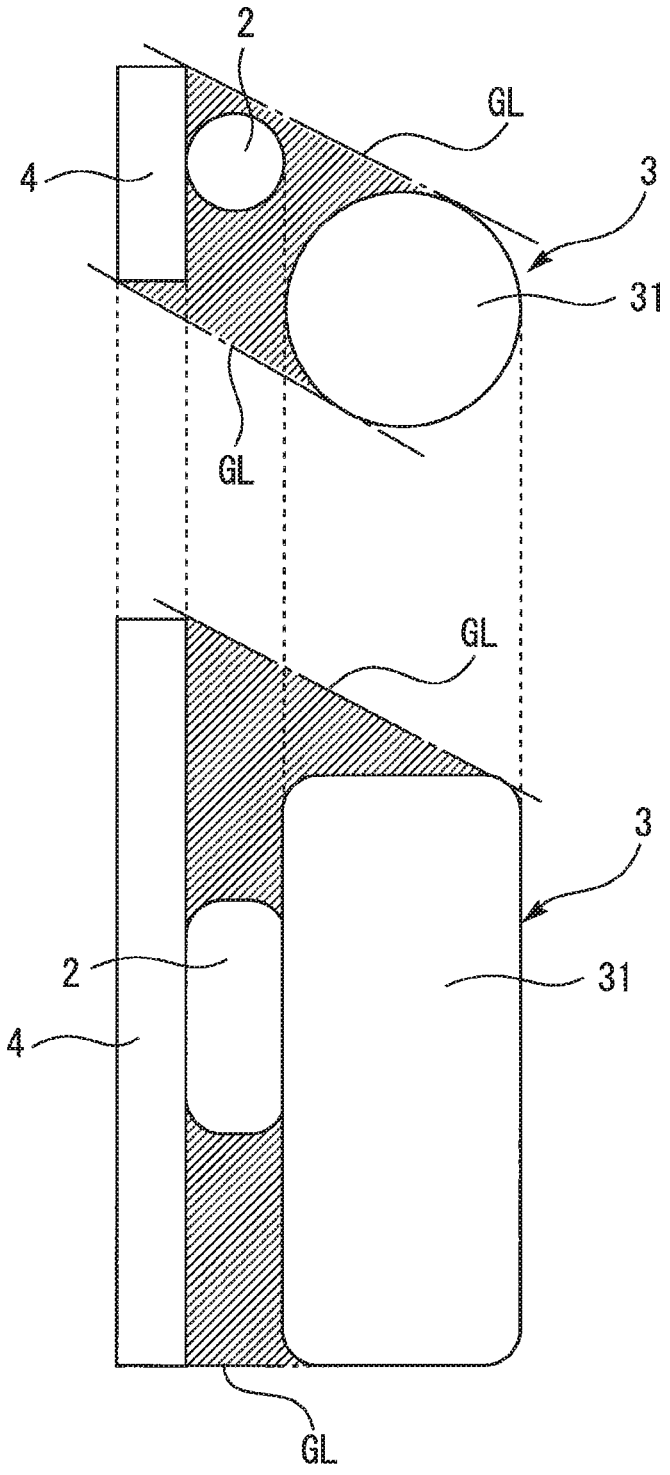
FIG. 6 is a two-dimensional view of a compressor, a discharge muffler, and the first heat exchanger according to the first embodiment of the present invention.

FIG. 6 is a two-dimensional view of the compressor 3, the discharge muffler 2, and the first heat exchanger 4 according to the present first embodiment. An upper half of FIG. 6 is a view of the compressor 3, the discharge muffler 2, and the first heat exchanger 4 from above. A lower half of FIG. 6 is a view of the compressor 3, the discharge muffler 2, and the first heat exchanger 4 from a horizontal direction. FIG. 6 shows an actual positional relationship among the compressor 3, the discharge muffler 2, and the first heat exchanger 4.

As shown in FIG. 6, the shell 31 and the discharge muffler 2 are spatially positioned adjacent to each other. The discharge muffler 2 and the first heat exchanger 4 are spatially positioned adjacent to each other. The discharge muffler 2 is at least partially positioned in a space between the shell 31 and the first heat exchanger 4. In this case, it is assumed that the space between the shell 31 and the first heat exchanger 4 refers to a space defined by a surface obtained by moving a straight line GL in contact with both the shell 31 and the first heat exchanger 4 as a generatrix, the outer surface of the shell 31, and the outer surface of the first heat exchanger 4. A hatched region in FIG. 6 corresponds to the space between the shell 31 and the first heat exchanger 4.

Due to the discharge muffler 2 being at least partially positioned in the space between the shell 31 and the first heat exchanger 4, the following effects are produced. The space is located between the first heat exchanger 4 having the second highest average outer surface temperature and the shell 31 having the third highest average outer surface temperature. Thus, an average air temperature of the space is higher than the average air temperature of the first space 63. Due to the discharge muffler 2 being at least partially positioned in the space, an average air temperature around the discharge muffler 2 can be increased as compared to when the discharge muffler 2 is not positioned in the space. As a result, due to the discharge muffler 2 being at least partially positioned in the space, heat dissipation loss from the outer surface of the discharge muffler 2 can be reduced. Reducing heat dissipation loss from the discharge muffler 2 whose outer surface reaches a highest average temperature is particularly important from the perspective of improving efficiency of the heat pump device 1. Reducing heat dissipation loss from the discharge muffler 2 produces the following effects. A drop in the temperature of the high pressure refrigerant received by the first heat exchanger 4 from the discharge muffler 2 can be reduced. A decline in efficiency of the first heat exchanger 4 can be reduced. A decline in water heating efficiency can be reduced.

In the present embodiment, the entire discharge muffler 2 is positioned in the space between the shell 31 and the first heat exchanger 4. Accordingly, heat dissipation loss from the discharge muffler 2 can be more reliably reduced.

Desirably, the outer surface of the discharge muffler 2 does not come into contact with the outer surface of the shell 31. In other words, desirably, a minimum distance between the outer surface of the discharge muffler 2 and the outer surface of the shell 31 is greater than zero. A difference in average temperature between the outer surface of the discharge muffler 2 and the outer surface of the shell 31 is larger than a difference in average temperature between the outer surface of the discharge muffler 2 and the outer surface of the first heat exchanger 4. When the outer surface of the discharge muffler 2 is in contact with the outer surface of the shell 31, heat is likely to migrate from the outer surface of the discharge muffler 2 to the outer surface of the shell 31. In the present embodiment, since the outer surface of the discharge muffler 2 does not come into contact with the outer surface of the shell 31, migration of heat from the outer surface of the discharge muffler 2 to the outer surface of the shell 31 can be more reliably reduced.

The discharge muffler 2 is desirably not fixed to the shell 31. In other words, desirably, the discharge muffler 2 is not coupled to the shell 31 by a member with high thermal conductivity such as a metal bracket or a metal band. Adopting such a configuration more reliably reduces migration of heat from the outer surface of the discharge muffler 2 to the outer surface of the shell 31.

As shown in FIG. 4, the heat pump device 1 according to the present embodiment includes a first thermal insulating material 16 and a second thermal insulating material 17. Cross sections of the first thermal insulating material 16 and the second thermal insulating material 17 are shown in FIG. 4. The first thermal insulating material 16 and the second thermal insulating material 17 are omitted in FIG. 6.

The first thermal insulating material 16 at least partially covers both the discharge muffler 2 and the first heat exchanger 4. According to the present embodiment, the following effects are produced due to the inclusion of the first thermal insulating material 16. Heat dissipation loss from the outer surface of the discharge muffler 2 and heat dissipation loss from the outer surface of the first heat exchanger 4 can be more reliably reduced. A drop in the temperature of the high pressure refrigerant received by the first heat exchanger 4 from the discharge muffler 2 can be more reliably reduced. A decline in efficiency of the first heat exchanger 4 can be more reliably reduced. A decline in water heating efficiency can be more reliably reduced.

According to the present embodiment, the shared first thermal insulating material 16 at least partially covers both the discharge muffler 2 and the first heat exchanger 4. As a result, compared to a case where an insulating material covering the discharge muffler 2 and an insulating material covering the first heat exchanger 4 are separately provided, heat dissipation loss can be reduced while reducing an amount of use of insulating materials.

The average temperature of the outer surface of the first heat exchanger 4 is higher than the average temperature of the outer surface of the shell 31. A difference between the average temperature of the outer surface of the discharge muffler 2 and the average temperature of the outer surface of the first heat exchanger 4 is smaller than a difference between the average temperature of the outer surface of the discharge muffler 2 and the average temperature of the outer surface of the shell 31 of the compressor 3. Thus, heat is relatively less likely to be transferred from the outer surface of the discharge muffler 2 to the outer surface of the first heat exchanger 4. As shown in FIGS. 4 and 6, the discharge muffler 2 may have a portion which comes into contact with or comes into proximity of the first heat exchanger 4 without an intervening thermal insulating material. Even when the discharge muffler 2 has a portion which comes into contact with or comes into proximity of the first heat exchanger 4 without an intervening thermal insulating material, heat is relatively less likely to be transferred from the outer surface of the discharge muffler 2 to the outer surface of the first heat exchanger 4. Due to the discharge muffler 2 having a portion which comes into contact with or comes into proximity of the first heat exchanger 4 without an intervening thermal insulating material, heat dissipation loss can be reduced while reducing an amount of use of insulating materials.

The second thermal insulating material 17 at least partially covers the shell 31 of the compressor 3. According to the present embodiment, the following effects are produced due to the inclusion of the second thermal insulating material 17. Heat dissipation loss from the outer surface of the shell 31 of the compressor 3 can be reduced. A drop in the temperature of the high pressure refrigerant received by the second heat exchanger 5 from the compressor 3 can be reduced. A decline in efficiency of the second heat exchanger 5 can be reduced. A decline in water heating efficiency can be reduced. The second thermal insulating material 17 desirably covers all of or more than half of the outer surface of the shell 31 of the compressor 3. The second thermal insulating material 17 is desirably in contact with the outer surface of the shell 31 of the compressor 3. A gap may exist between the second thermal insulating material 17 and the outer surface of the shell 31 of the compressor 3.

The heat pump device 1 according to the present embodiment is provided with a thermal insulator which is at least partially positioned in a space where a distance between the outer surface of the shell 31 and the outer surface of the discharge muffler 2 is minimum. In the present embodiment, the second thermal insulating material 17 corresponds to the thermal insulator. The following effects are produced due to the inclusion of the thermal insulator. The transfer of heat from the discharge muffler 2 to the shell 31 of the compressor 3 can be more reliably reduced. A drop in the temperature of the high pressure refrigerant received by the first heat exchanger 4 from the discharge muffler 2 can be more reliably reduced. A decline in efficiency of the first heat exchanger 4 can be more reliably reduced. A decline in water heating efficiency can be more reliably reduced.

As shown in FIG. 4, the second thermal insulating material 17 is provided with a portion 17*a* positioned in a space where the distance between the outer surface of the shell 31 and the outer surface of the discharge muffler 2 is minimum. The portion 17*a* of the second thermal insulating material 17 can reliably reduce migration of heat from the outer surface of the discharge muffler 2 to the outer surface of the shell 31. Instead of the illustrated configuration, the first thermal insulating material 16 may include a portion positioned in the space where the distance between the outer surface of the shell 31 and the outer surface of the discharge muffler 2 is minimum Instead of the second thermal insulating material 17, the first thermal insulating material 16 may include a portion positioned in the space where the distance between the outer surface of the shell 31 and the outer surface of the discharge muffler 2 is minimum.

Favorable examples of the thermal insulator or the thermal insulating materials according to the present invention include those using foamed plastic, glass wool, rock wool, or a vacuum insulation panel. In addition, the thermal insulator or the thermal insulating materials according to the present invention may include a plurality of these materials.

Desirably, the first thermal insulating material 16 has higher thermal resistance than the second thermal insulating material 17. The temperatures of the outer surfaces of the discharge muffler 2 and the first heat exchanger 4 are higher than the temperature of the outer surface of the shell 31 of the compressor 3. By setting the thermal resistance of the first thermal insulating material 16 higher than the thermal resistance of the second thermal insulating material 17, heat dissipation loss from the outer surfaces of the discharge muffler 2 and the first heat exchanger 4 which reach a higher temperature than the outer surface of the shell 31 can be more reliably reduced. The temperature of the outer surface of the shell 31 of the compressor 3 is lower than the temperatures of the outer surfaces of the discharge muffler 2 and the first heat exchanger 4. Thus, even when the thermal resistance of the second thermal insulating material 17 covering the shell 31 of the compressor 3 is somewhat lower than the thermal resistance of the first thermal insulating material 16, heat dissipation loss is hardly affected. Setting the thermal resistance of the second thermal insulating material 17 lower than the thermal resistance of the first thermal insulating material 16 enables the second thermal insulating material 17 to be constructed in an inexpensive manner.

Thermal conductivity of the first thermal insulating material 16 may be set lower than thermal conductivity of the second thermal insulating material 17. For example, the first thermal insulating material 16 may include a vacuum insulation panel. For example, the second thermal insulating material 17 may include glass wool, rock wool, or foamed plastic. The material of the first thermal insulating material 16 may be the same as the material of the second thermal insulating material 17. In this case, by setting a thickness of the first thermal insulating material 16 to be thicker than a thickness of the second thermal insulating material 17, the thermal resistance of the first thermal insulating material 16 can be set higher than the thermal resistance of the second thermal insulating material 17.

As shown in FIG. 4, the first thermal insulating material 16 includes a first section 16*a* and a second section 16*b*. The first section 16*a* is at least partially positioned in a space between the bulkhead 65 and the discharge muffler 2 or the first heat exchanger 4. The second section 16*b* does not have a portion positioned in the space between the bulkhead 65 and the discharge muffler 2 or the first heat exchanger 4. The first section 16*a* has higher thermal resistance than the second section 16*b*.

An average air temperature of the second space 64 is lower than an air temperature outside of the housing 62 of the heat pump device 1. Thus, a temperature of the bulkhead 65 tends to drop. By increasing the thermal resistance of the first section 16*a* which at least partially faces the low temperature bulkhead 65, migration of heat of the discharge muffler 2 or the first heat exchanger 4 to the low temperature bulkhead 65 can be more reliably reduced. The thermal resistance of the second section 16*b* not having a portion opposing the low temperature bulkhead 65 hardly affects heat dissipation loss even when the thermal resistance is somewhat lower than the thermal resistance of the first section 16*a*. Setting the thermal resistance of the second section 16*b* lower than the thermal resistance of the first section 16*a* enables the second section 16*b* to be constructed in an inexpensive manner.

Thermal conductivity of the first section 16*a* may be set lower than thermal conductivity of the second section 16*b*. For example, the first section 16*a* may include a vacuum insulation panel. For example, the second section 16*b* may include glass wool, rock wool, or foamed plastic. The material of the first section 16*a* may be the same as the material of the second section 16*b*. In this case, by setting a thickness of the first section 16*a* to be thicker than a thickness of the second section 16*b*, the thermal resistance of the first section 16*a* can be set higher than the thermal resistance of the second section 16*b*.

The present embodiment adopts the following configuration. The first section 16*a* includes an end in contact with or in proximity of the second thermal insulating material 17 and an end in contact with or in proximity of the second section 16*b*. The second section 16*b* includes an end in contact with or in proximity of the second thermal insulating material 17 and an end in contact with or in proximity of the first section 16*a*. The discharge muffler 2 is in contact with or in proximity of an outer surface of the portion 17*a* of the second thermal insulating material 17. A part of the second thermal insulating material 17 and the first thermal insulating material 16 enclose entire outer peripheries of the discharge muffler 2 and the first heat exchanger 4. Such a configuration is not restrictive and the first thermal insulating material 16 may enclose the entire outer peripheries of the discharge muffler 2 and the first heat exchanger 4. Moreover, while a state where the first thermal insulating material 16 covers side peripheral surfaces of the discharge muffler 2 and the first heat exchanger 4 is shown in FIG. 4, the first thermal insulating material 16 desirably also covers top surfaces and bottom surfaces of the discharge muffler 2 and the first heat exchanger 4.

In the present embodiment, the first thermal insulating material 16 covers a part of the first pipe 35. Accordingly, heat dissipation loss from an outer surface of the first pipe 35 which reaches a high temperature can be reduced. Such a configuration is not restrictive and an insulating material which differs from the first thermal insulating material 16 may cover the first pipe 35. The entire first pipe 35 may be covered by the insulating material.

In the present embodiment, the first thermal insulating material 16 covers a part of the second pipe 40. Accordingly, heat dissipation loss from an outer surface of the second pipe 40 which reaches a high temperature can be reduced. Such a configuration is not restrictive and an insulating material which differs from the first thermal insulating material 16 may cover the second pipe 40. The entire second pipe 40 may be covered by the insulating material.

Moreover, in the present invention, one of or both of the first thermal insulating material 16 and the second thermal insulating material 17 may be omitted. Even when the first thermal insulating material 16 and the second thermal insulating material 17 are absent, due to the discharge muffler 2 being at least partially positioned in the space between the shell 31 and the first heat exchanger 4, the following effects are produced. Heat dissipation loss from the outer surface of the discharge muffler 2 can be reduced. Heat transferred from the discharge muffler 2 to the outer surface of the shell 31 of the compressor 3 is absorbed by a high pressure refrigerant in the internal spaces 38 and 39 of the shell 31. Due to the high pressure refrigerant heating water in the second heat exchanger 5, heat transferred from the discharge muffler 2 to the shell 31 of the compressor 3 can be recovered. Heat transferred from the discharge muffler 2 to the refrigerant pipe 4*e* of the first heat exchanger 4 is absorbed by a high pressure refrigerant in the refrigerant passage 4*a*. Due to the high pressure refrigerant heating water in the heating medium passage 4*b*, heat transferred from the discharge muffler 2 to the outer surface of the refrigerant pipe 4*e* of the first heat exchanger 4 can be recovered. According to the above, even when the first thermal insulating material 16 and the second thermal insulating material 17 are absent, due to the discharge muffler 2 being at least partially positioned in the space between the shell 31 and the first heat exchanger 4, a decline in water heating efficiency can be reduced.

Second Embodiment

Next, while a second embodiment of the present invention will be described with reference to FIG. 7, the description will focus on differences from the first embodiment described above and same or equivalent portions will be referred to by the same names and descriptions thereof will be simplified or omitted.

Figure 7:
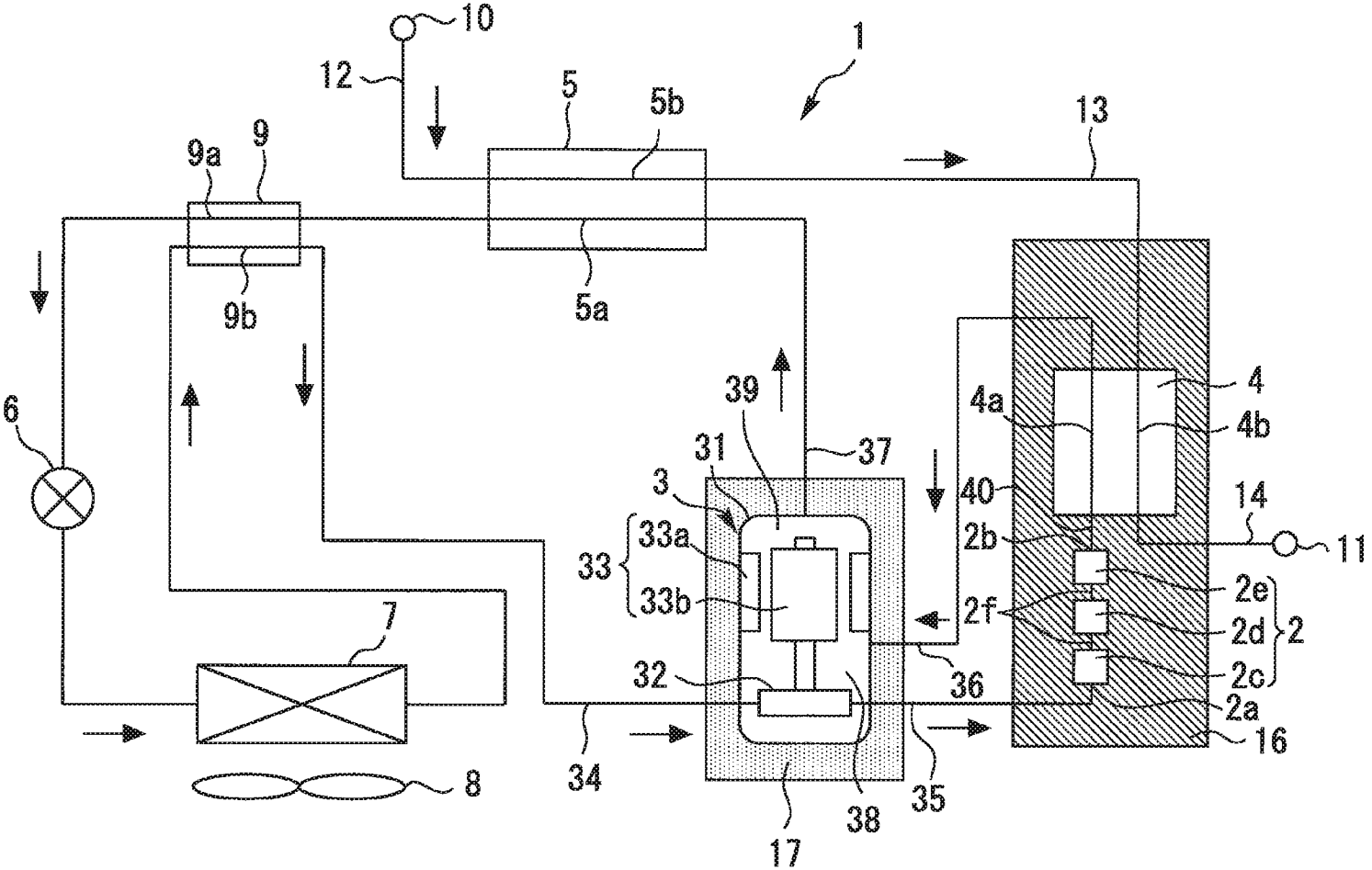
FIG. 7 is a diagram showing a refrigerant circuit configuration of a heat pump device according to a second embodiment of the present invention.

FIG. 7 is a diagram showing a refrigerant circuit configuration of a heat pump device according to the second embodiment of the present invention. As shown in FIG. 7, a discharge muffler 2 provided in a heat pump device 1 according to the present second embodiment includes a plurality of muffler sections 2*c*, 2*d*, and 2*e* connected in series. Each of the muffler sections 2*c*, 2*d*, and 2*e* has a larger internal space than a first pipe 35. The muffler sections 2*c*, 2*d*, and 2*e* are mutually connected using pipes 2*f*. A sum of outer surface area of each of the muffler sections 2*c*, 2*d*, and 2*e* is smaller than the outer surface area of the discharge muffler 2 according to the first embodiment. According to the present second embodiment, since the outer surface area of the discharge muffler 2 can be reduced, heat dissipation loss from the outer surface of the discharge muffler 2 can be more reliably reduced. While three muffler sections 2*c*, 2*d*, and 2*e* are connected in series in the discharge muffler 2 according to the present embodiment, two muffler sections may be connected in series, or four or more muffler sections may be connected in series.

A refrigerant circuit configuration of the heat pump device according to the present invention is not limited to the configurations adopted in the embodiments. For example, the present invention can also be applied to a two-stage compression type heat pump device which includes a low-stage compressing unit and a high-stage compressing unit inside a shell. In a two-stage compression type heat pump device, a refrigerant at intermediate pressure having been compressed by the low-stage compressing unit fills the inside of the shell and a high pressure refrigerant compressed by the high-stage compressing unit is supplied to a discharge muffler. In the two-stage compression type heat pump device, a temperature of an outer surface of the discharge muffler is higher than a temperature of an outer surface of the shell and, at the same time, the temperature of the outer surface of the discharge muffler is higher than a temperature of an outer surface of a first heat exchanger connected to the discharge muffler. Applying the present invention to the two-stage compression type heat pump device reliably reduces heat dissipation loss from the outer surface of the discharge muffler.

The invention claimed is:

1. A heat pump device, comprising:
a compressor configured to compress refrigerant;
a motor configured to drive the compressor;
a shell housing the compressor and the motor;
a discharge muffler being outside of the shell;
a first pipe connecting the compressor to the discharge muffler;
a first heat exchanger including a refrigerant inlet, the first heat exchanger being configured to exchange heat between the refrigerant and a liquid heating medium;
a second pipe connecting the discharge muffler to the refrigerant inlet of the first heat exchanger;
a housing having a first space and a second space therein; and
a blower,
wherein the shell, the first heat exchanger, and the discharge muffler are disposed in the first space,
wherein the blower is disposed in the second space,
wherein the discharge muffler is entirely located within a space between the shell and the first heat exchanger,
wherein the heat pump device further comprises a first thermal insulating material positioned so as to at least partially cover the discharge muffler and the first heat exchanger,
wherein the heat pump device further comprises a second thermal insulating material positioned so as to at least partially cover the shell, and
wherein the first thermal insulating material has higher thermal resistance than the second thermal insulating material.

2. The heat pump device according to claim 1,
wherein the space between the shell and the first heat exchanger is defined as a space between two vertical planes that are respectively tangential to two outer surfaces of the first heat exchanger and two outer surfaces of the shell.

3. The heat pump device according to claim 1,
wherein the discharge muffler is entirely located in a space defined as a space between two vertical plans that are respectively tangential to two outer surfaces of the first heat exchanger and two outer surfaces of the shell.

4. The heat pump device according to claim 1, wherein:
the shell includes a refrigerant inlet and a refrigerant outlet,
the first heat exchanger includes a refrigerant outlet,
the heat pump device further comprising:
a third pipe connecting the refrigerant outlet of the first heat exchanger to the refrigerant inlet of the shell;
a second heat exchanger including a refrigerant inlet, the second heat exchanger being configured to exchange heat between the refrigerant and the heating medium; and
a fourth pipe connecting the refrigerant outlet of the shell to the refrigerant inlet of the second heat exchanger.

5. The heat pump device according to claim 1,
wherein the discharge muffler has a portion coming into contact with the first heat exchanger without an intervening thermal insulating material.

6. The heat pump device according to claim 1,
wherein the discharge muffler includes a plurality of muffler sections connected in series.

7. The heat pump device according to claim 1,
wherein the discharge muffler does not come into contact with the shell.

8. The heat pump device according to claim 1,
wherein the discharge muffler is not fixed to the shell.

9. The heat pump device according to claim 1, further comprising:
a bulkhead configured to separate the first space and the second space from each other; and
an evaporator configured to exchange heat between the refrigerant and air blown by the blower.

10. The heat pump device according to claim 1,
wherein the first thermal insulating material is positioned to at least partially cover the first pipe.

11. The heat pump device according to claim 1,
wherein the first thermal insulating material is of a different composition than the second thermal insulating material.

12. The heat pump device according to claim 11, wherein:
the first thermal insulating material consists of a vacuum insulation panel, and
the second thermal insulating material consists of one of glass wool, rock wool, and foamed plastic.

13. The heat pump device according to claim 11,
wherein the first thermal insulating material and the second thermal insulating material each consist of a single type of insulating material that is not a composite material.

14. The heat pump device according to claim 1, wherein:
the first thermal insulating material and the second thermal insulating material are the same insulating material, and
the first thermal insulating material is thicker than the second thermal insulating material.

15. The heat pump device according to claim 1, wherein:
the heat pump device further comprises an evaporator configured to evaporate the refrigerant,
the heat pump device further comprises a bulkhead configured to separate the first space and the second space from each other, the evaporator being located in the second space,
the first thermal insulating material includes a first section at least partially located in a space between the bulkhead and the discharge muffler or the first heat exchanger and also includes a second section not having a portion located in a space between the bulkhead and the discharge muffler or the first heat exchanger, and
the first section has higher thermal resistance than the second section.

16. A heat pump device, comprising:
a compressor configured to compress refrigerant;
a motor configured to drive the compressor;
a shell housing the compressor and the motor;
a discharge muffler being outside of the shell;
a first pipe connecting the compressor to the discharge muffler;
a first heat exchanger including a refrigerant inlet, the first heat exchanger being configured to exchange heat between the refrigerant and a liquid heating medium;
a second pipe connecting the discharge muffler to the refrigerant inlet of the first heat exchanger;

a housing having a first space and a second space therein; and a blower, wherein the shell, the first heat exchanger, and the discharge muffler are disposed in the first space, wherein the blower is disposed in the second space, wherein the discharge muffler is entirely located within a space between the shell and the first heat exchanger, wherein the heat pump device further comprises an evaporator configured to evaporate the refrigerant, wherein the heat pump device further comprises a bulkhead configured to separate the first space and the second space from each other, the evaporator being located in the second space, wherein the heat pump device further comprises a thermal insulating material positioned so as to at least partially cover the discharge muffler and the first heat exchanger, wherein the thermal insulating material includes a first section at least partially located in a space between the bulkhead and the discharge muffler or the first heat exchanger and also includes a second section not having a portion located in a space between the bulkhead and the discharge muffler or the first heat exchanger, and wherein the first section has higher thermal resistance than the second section.

17. The heat pump device according to claim 16, wherein:

the first section consists of a vacuum insulation panel, and the second section consists of one of glass wool, rock wool, and foamed plastic.

18. The heat pump device according to claim 16, wherein:

the first section and the second section are made of the same insulating material, and the first section is thicker than the second section.

19. The heat pump device according to claim 16, wherein:

one end of the first section contacts a second thermal insulating material positioned so as to at least partially cover the shell, and a different end of the first section contacts the second section.

20. The heat pump device according to claim 19, wherein:

the different end of the first section contacts one end of the second section, and a different end of the second section contacts the second thermal insulating material.

* * * * *